US009376177B2

(12) United States Patent
Swift

(10) Patent No.: US 9,376,177 B2
(45) Date of Patent: Jun. 28, 2016

(54) WATER SLED APPARATUS

(71) Applicant: Richard George Swift, Lloydminster (CA)

(72) Inventor: Richard George Swift, Lloydminster (CA)

( * ) Notice: Subject to any disclaimer, the term of this patent is extended or adjusted under 35 U.S.C. 154(b) by 0 days.

(21) Appl. No.: 14/249,322

(22) Filed: Apr. 9, 2014

(65) Prior Publication Data

US 2014/0329424 A1 Nov. 6, 2014

Related U.S. Application Data

(63) Continuation-in-part of application No. 13/028,218, filed on Feb. 16, 2011, now abandoned.

(60) Provisional application No. 61/305,105, filed on Feb. 16, 2010.

(51) Int. Cl.
*B63B 35/79* (2006.01)
*B63B 35/81* (2006.01)

(52) U.S. Cl.
CPC ..... *B63B 35/7906* (2013.01); *B63B 35/81* (2013.01); *B63B 2035/7903* (2013.01)

(58) Field of Classification Search
CPC ..... B63B 35/81; B63B 35/811; B63B 2035/7903; B63B 35/7906
USPC ..... 441/65–79; 114/242–254
See application file for complete search history.

(56) References Cited

U.S. PATENT DOCUMENTS

| | | | | |
|---|---|---|---|---|
| 3,930,460 | A * | 1/1976 | Beck | 441/69 |
| 2009/0305588 | A1* | 12/2009 | McKee | 441/67 |
| 2010/0151754 | A1* | 6/2010 | Duff et al. | 441/79 |

* cited by examiner

*Primary Examiner* — Andrew Polay
(74) *Attorney, Agent, or Firm* — Michael Ries

(57) ABSTRACT

A towed water sled apparatus is disclosed. The towed water sled apparatus is designed to provide lift to an overturned water sled apparatus thereby preventing the overturned water sled apparatus from diving below the water surface. The towing line may be above the water surface while pulling the overturned water sled apparatus along the water surface. The nose radius may transition to the lift section to provide lift to the overturned water sled apparatus and prevent the overturned water sled apparatus from sinking into the water surface.

14 Claims, 7 Drawing Sheets

WATER SLED APPARATUS

This Continuation-In-Part application claims priority to U.S. Non-Provisional application Ser. No. 13/028,218 filed on Feb. 16, 2011, which claims priority to U.S. Provisional Application 61/305,105 filed on Feb. 16, 2010, the entire disclosure of which is incorporated by reference.

TECHNICAL FIELD & BACKGROUND

The present invention generally relates to a water sled apparatus. More specifically, the invention is a towable water sled apparatus.

It is an object of the invention to provide a towable water sled apparatus that is easily maneuvered by a rider.

It is an object of the invention to provide a towable water sled apparatus that greatly reduces diving or sinking while being towed, especially in an overturned position.

It is an object of the invention to provide a towable water sled apparatus that does not require a rider be strapped to the water sled apparatus while riding.

What is really needed is a towable water sled apparatus that is easily maneuvered by a rider, greatly reduces diving or sinking while being towed, especially in an overturned position and that does not require a rider be strapped to the water sled apparatus while riding.

BRIEF DESCRIPTION OF THE DRAWINGS

The present invention will be described by way of exemplary embodiments, but not limitations, illustrated in the accompanying drawing in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
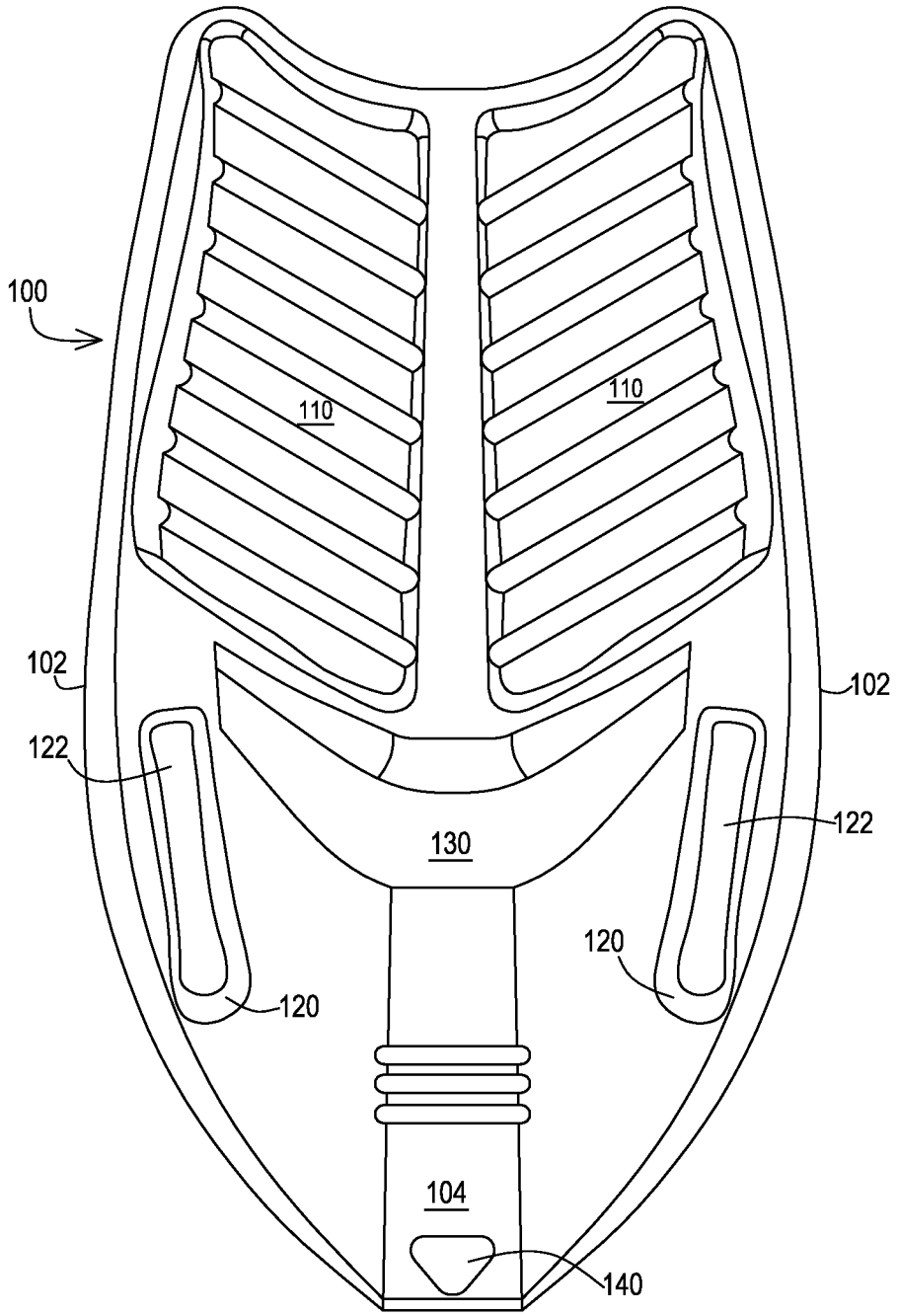
FIG. 1 illustrates an overhead perspective view of an overturned water sled apparatus, in accordance with one embodiment of the present invention.

FIG. 1 illustrates an overhead front perspective view of a water sled apparatus 100, in accordance with one embodiment of the present invention. The water sled apparatus 100 may be towed behind a watercraft (not shown) and allows a rider to steer the water sled apparatus 100 easily without being strapped to the water sled apparatus 100. The water sled apparatus 100 may be utilized by very young riders with much less chance of injury because the rider may be not strapped to the water sled apparatus 100 while riding.

The water sled apparatus 100 may include a pair of knee indentations 110, a pair of handles 120, a bumper pad 130 and a hitching aperture 140.

The knee indentations 110 may be disposed on a top surface 100A of the water sled apparatus 100 and accommodate any sized user rider. The pair of handles 120 may be disposed on a pair of top facing edges 100A of the water sled apparatus 100 and may be grasped by a user to secure the user to the overturned water sled apparatus 100 while utilizing the water sled apparatus 100. The user rider may ride the water sled apparatus 100 in a kneeling position in the knee indentations 110 while holding the pair of handles 120. The pair of handles 120 may be made from solid plastic or metal. The pair of handles 120 may also have a non-slip gripping surface 122 to allow the rider to better grasp the pair of handles 120 and better maneuver the water sled apparatus 100. The non-slip gripping surface 122 may be made of rubber or any other suitable material. The bumper pad 130 may be disposed in front of the knee indentations 110 to prevent the rider from being thrown forward out of the knee indentations 110 and to provide padding and protection when the rider bumps forwards into the bumper pads 130. The hitching aperture 140 may be disposed on the front or hull 104 of the water sled apparatus 100 and receives and couples a towing line (FIG. 3, 320) to pull the water sled apparatus 100.

The water sled apparatus 100 has a solid hull 104 made of and formed from molded plastic or compression formed polymer and the pair of handles 120 may be made from solid plastic or metal. The knee indentations 110 and bumper pads 130 may be made of any type of foam rubber that may be suitable for utilization with the water sled apparatus 100. The water sled apparatus 100 may be towable and may be easily maneuvered by the rider. This may be in contrast to an inflatable towable water sled or water recreation apparatus which may be hard to maneuver. The water sled apparatus 100 reduces diving or sinking while being towed without the rider in an upright or overturned position. The water sled apparatus 100 may be designed to plane or stay on the water surface in any position with or without the rider.

Figure 2:
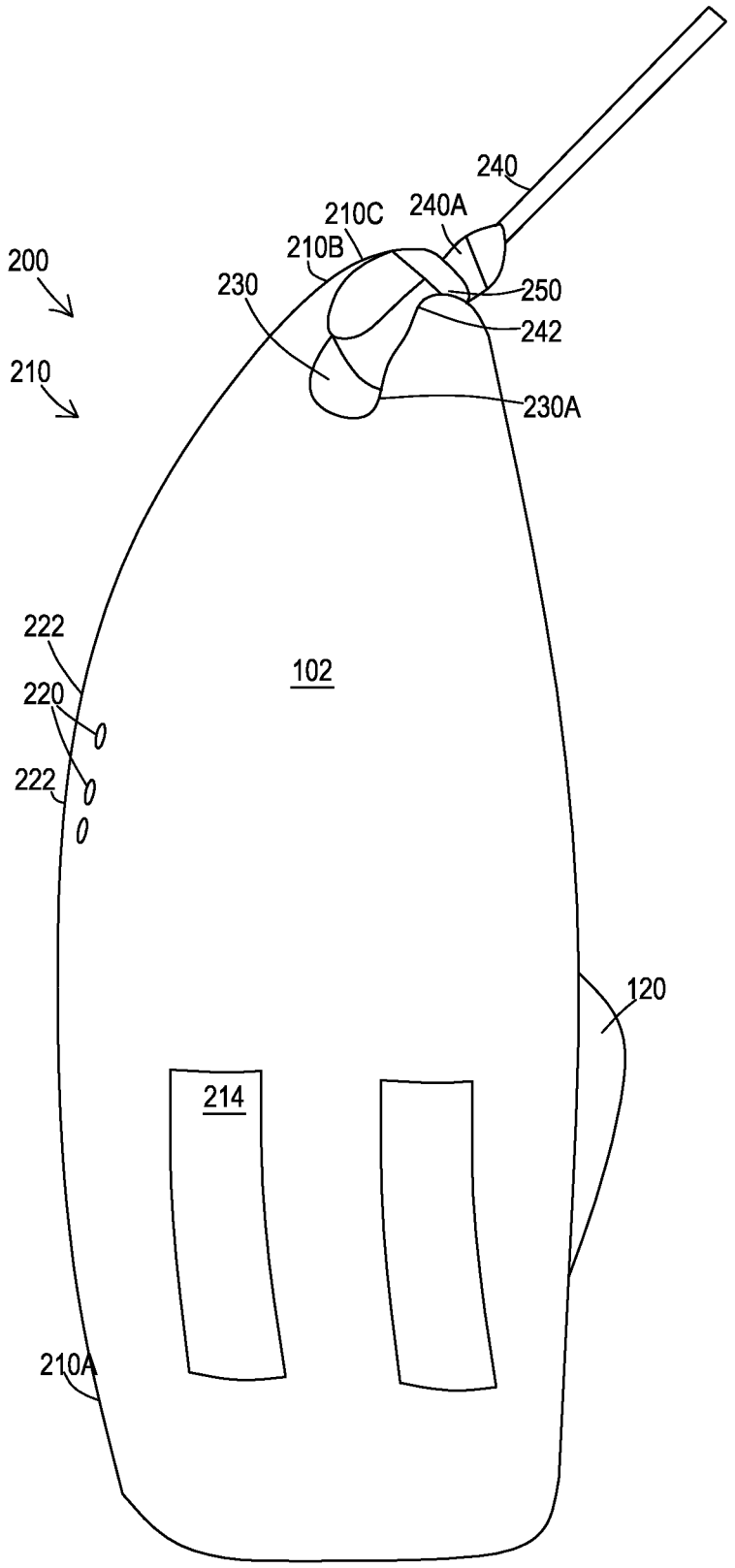
FIG. 2 illustrates an overhead view of a water sled apparatus, in accordance with one embodiment of the present invention.

FIG. 2 illustrates an overhead view of a water sled apparatus 200, in accordance with one embodiment of the present invention. The water sled apparatus 200 illustrated in FIG. 2 is in an overturned position.

The water sled apparatus 200 may include a base water sled apparatus 210, a plurality of fasteners 220, an attachment aperture 230, a towing line 240 and a nose radius 250.

The base water sled apparatus 210 may have a bottom facing 212. The bottom facing 212 may include an elongated indenture 214 that may be centered on the bottom facing 212. The elongated indenture 214 may extend from a first end 210A of the base water sled apparatus 210 and may provide lift to the overturned water sled apparatus 200 thereby preventing the overturned water sled apparatus 200 from diving below a water surface (not shown). The fasteners 220 may be disposed on the bottom facing 212 and secure a pair of handles (FIG. 1, 120) to the base water sled apparatus 210. The fasteners 220 illustrated in FIG. 2 are a plurality of rivets 222 but may be any suitable fastener. The attachment aperture 230 may be disposed on a second end 210B of the base water sled apparatus 210. The towing line 240 includes a securing strap 242 that may be coupled to a first end 240A of the towing line 240. The securing strap 242 may be coupled to the first end 240A of the towing line 240 by knotting the securing strap 242 to the first end 240A of the towing line 240. The securing strap 242 may be extended through the attachment aperture 230 and looped back and coupled to the first end 240A of the towing line 240 to pull the overturned water sled apparatus 200 along a water surface. The attachment aperture 230 may have a plurality of rounded edges 230A to reduce damage to the securing strap 242 or other suitable line inserted through the attachment aperture 230. The towing line 240 may be above the water surface while pulling the overturned water sled apparatus 200 along the water surface. The nose radius 250 may be disposed on a tip 210C of the second end 210B of the water sled apparatus 200 in front of the attachment aperture 230. The nose radius 250 may be disposed horizontally across the tip 210C of the second end 210B of the water sled apparatus 200. The nose radius 250 may be approximately one half inch in diameter or any other suitable diameter.

Figure 3A:
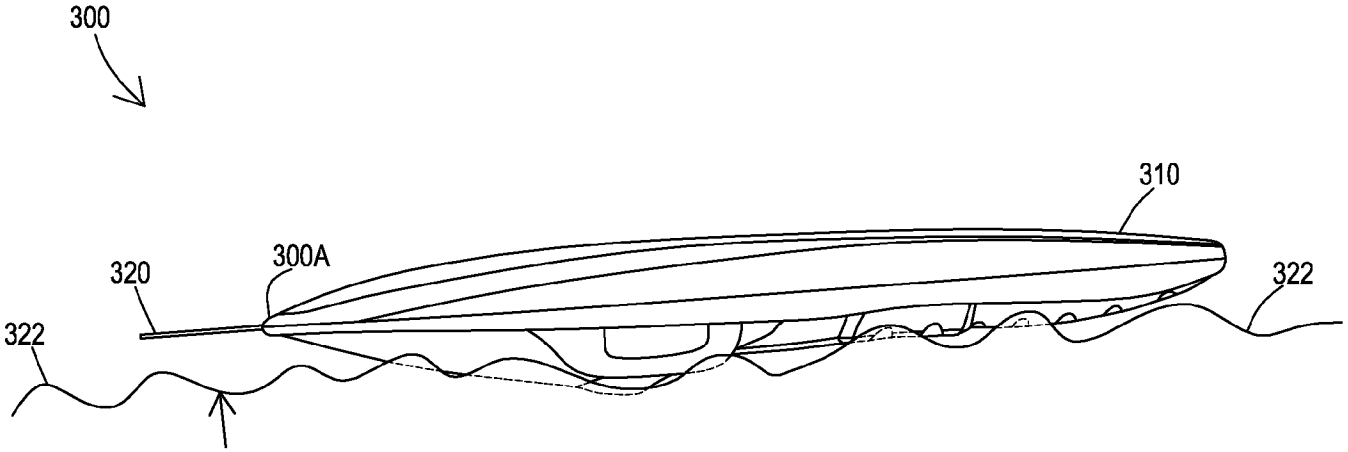
FIG. 3A illustrates a side view of an overturned water sled apparatus, in accordance with one embodiment of the present invention.

FIG. 3A illustrates a side view of an overturned water sled apparatus 300, in accordance with one embodiment of the present invention.

The overturned water sled apparatus 300 may include a base water sled apparatus 310 and a towing line 320. The base water sled apparatus 310 may have similar properties and elements as the overturned water sled apparatus 300. In contrast to the overturned water sled apparatus 300, the base water sled apparatus 310 may be in an upright position. The towing line 320 may be coupled to a first end 300A of the overturned water sled apparatus 300 to pull the overturned water sled apparatus 300 along a water surface 322. The overturned water sled apparatus 300 may be designed to provide lift to the overturned water sled apparatus 300 thereby preventing the overturned water sled apparatus 300 from diving below the water surface 322. The towing line 320 may be above the water surface 322 while pulling the overturned water sled apparatus 300 along the water surface 322.

Figure 3B:
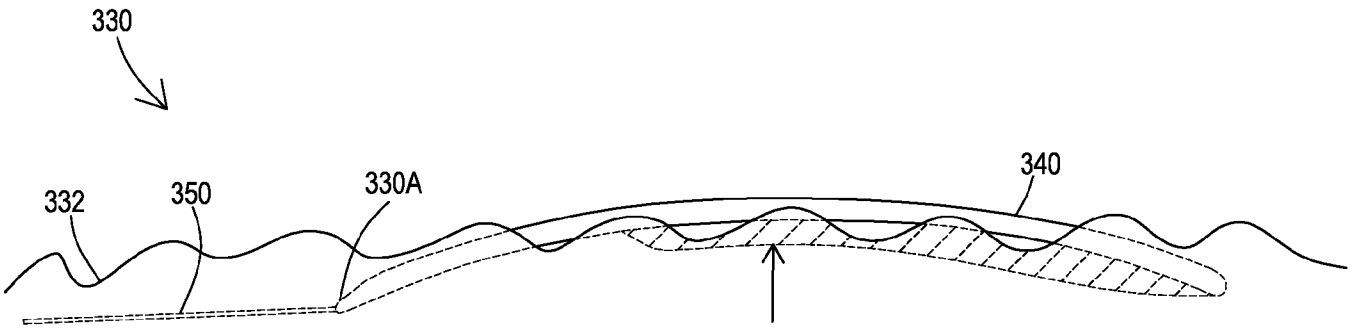
FIG. 3B illustrates a side view of a traditional overturned kneeboard, in accordance with one embodiment of the present invention.

FIG. 3B illustrates a side view of a traditional overturned kneeboard 330, in accordance with one embodiment of the present invention.

The traditional overturned kneeboard 330 may include a traditional kneeboard 340 and a towing line 350. The traditional kneeboard 340 may have similar properties and elements as the traditional overturned kneeboard 330. In contrast to the traditional overturned kneeboard 330, the traditional kneeboard 340 may be in an upright position. The towing line 350 may be coupled to a first end 330A of the traditional overturned kneeboard 330 to pull the traditional overturned kneeboard 330 along a water surface 332. The towing line 350 may be underneath the water surface 332 while pulling the traditional overturned kneeboard 330 along the water surface 332. This is in contrast to the towing line 320 of the overturned water sled apparatus 300 which may be above the water surface 322 while pulling the overturned water sled apparatus 300 along the water surface 322. The traditional overturned kneeboard 330 may also be further underwater than the overturned water sled apparatus 300. The traditional overturned kneeboard 330 may not provide any lift section on the top surface of the water. The traditional overturned kneeboard 330 may not provide any lift section on the top surface of the water. This may cause the traditional overturned kneeboard 330 to dive while being pulled while overturned. Therefore the traditional overturned kneeboard 330 may not be attached to a tow vehicle.

Figure 4:
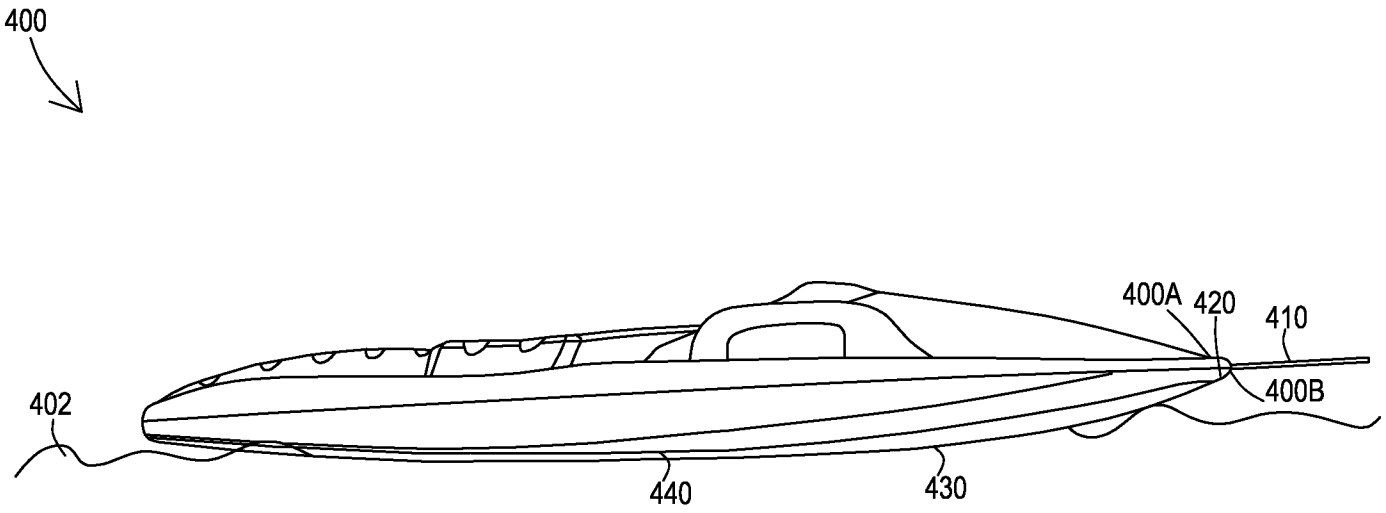
FIG. 4 illustrates a side perspective view of a water sled apparatus and a towing line, in accordance with one embodiment of the present invention.

FIG. 4 illustrates a side perspective view of a water sled apparatus 400 and a towing line 410, in accordance with one embodiment of the present invention.

The water sled apparatus 400 may include a towing line 410, a nose radius 420, a lift section 430 and a running surface 440.

The towing line 410 may be coupled to a first end 400A of the water sled apparatus 400 to pull the water sled apparatus 400 along a water surface 402. The nose radius 420 may be disposed on a tip 400B of the first end 400A of the water sled apparatus 400. The nose radius 420 may be approximately one half inch in diameter or any other suitable diameter. The lift section 430 may decline from the nose radius 420 in the range of approximately twelve to fifteen degrees or other suitable range. The running surface 440 may extend from the lift section 430 and may be in contact with the water surface 402 as the water sled apparatus 400 may be pulled by the towing line 410.

Figure 5:
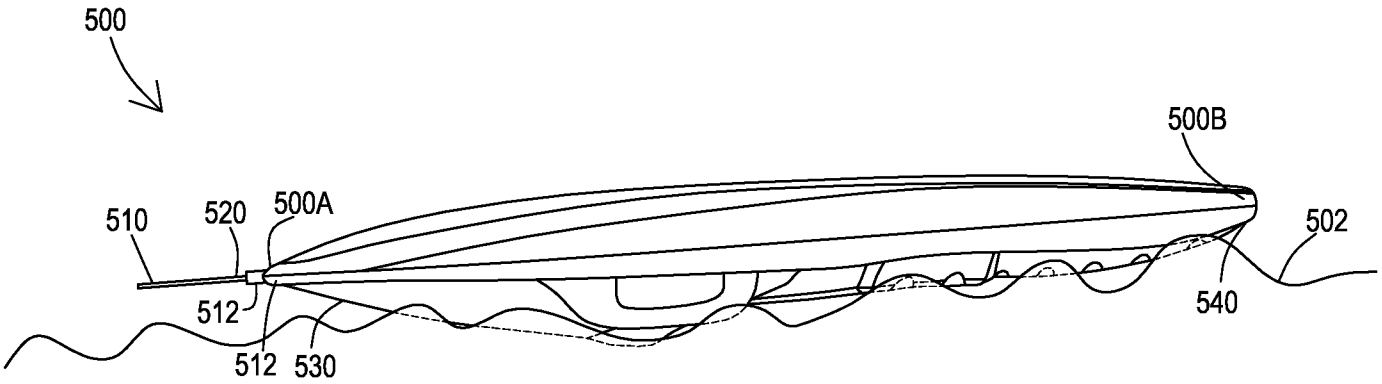
FIG. 5 illustrates a side view of an overturned water sled apparatus, in accordance with one embodiment of the present invention.

FIG. 5 illustrates a side view of an overturned water sled apparatus 500, in accordance with one embodiment of the present invention.

The overturned water sled apparatus 500 may include a towing line 510, a nose radius 520, a lift section 530 and a running surface 540.

The towing line 510 includes a securing strap 512 that may be coupled to a first end 500A of the towing line 510. The securing strap 512 may be extended through an attachment aperture 514 and looped back and coupled to the first end 500A of the towing line 510 to pull the overturned water sled apparatus 500 along a water surface. The towing line 510 may be above the water surface while pulling the overturned water sled apparatus 500 along the water surface. The towing line 510 may be coupled at midline to the first end 500A of the overturned water sled apparatus 500 or other suitable orientation. The nose radius 520 may be disposed on the first end 500A of the water sled apparatus 500 in front of the attachment aperture 514. The nose radius 520 may be approximately one half inch in diameter or any other suitable diameter. The lift section 530 may decline from the nose radius 520 in the range of approximately twelve to fifteen degrees or other suitable range. The nose radius 520 may transition to the lift section 530 to provide lift to the overturned water sled apparatus 500 and prevent the overturned water sled apparatus 500 from sinking into the water surface 502. The running surface 540 may extend from the lift section 530 to a second end 500B of the overturned water sled apparatus 500. The second end 500B may be in contact with the water surface 502 as the overturned water sled apparatus 500 may be pulled by the towing line 510.

Figure 6:
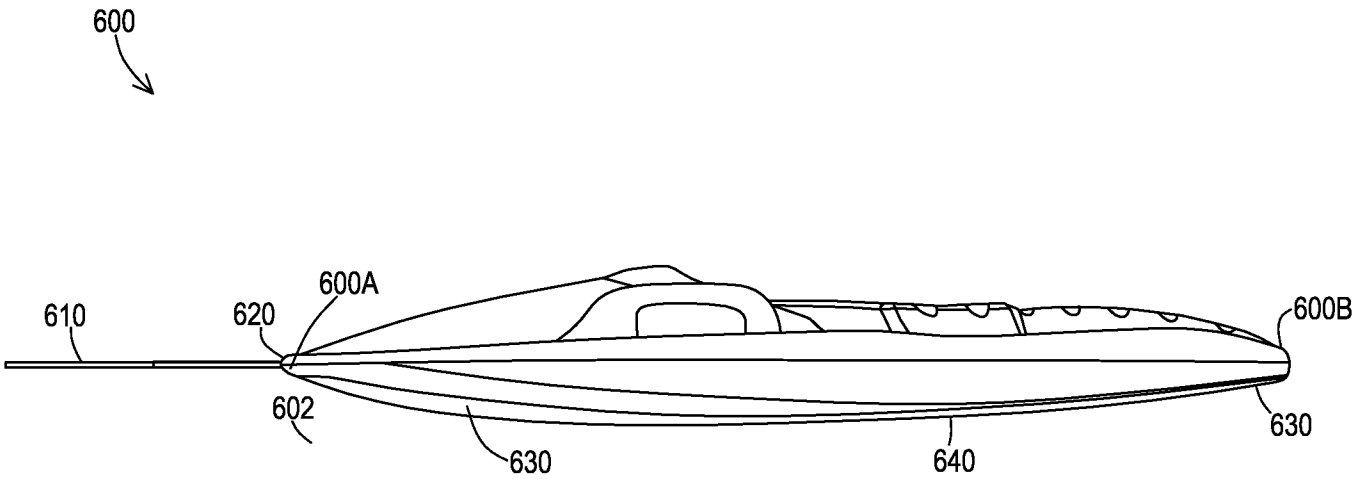
FIG. 6 illustrates a side view of a water sled apparatus, in accordance with one embodiment of the present invention.

FIG. 6 illustrates a side view of a water sled apparatus 600, in accordance with one embodiment of the present invention.

The water sled apparatus 600 may include a towing line 610, a nose radius 620, a pair of lift sections 630 and a running surface 640. The towing line 610 may be coupled at midline to the first end 600A of the overturned water sled apparatus 600 or other suitable orientation. The nose radius 620 may be disposed on the first end 600A of the water sled apparatus 600 where the towing line 610 may be coupled to a first end 600A of the water sled apparatus 600. The nose radius 620 may be approximately one half inch in diameter or any other suitable diameter. The nose radius 620 may transition to the pair of lift sections 630 to provide lift to the overturned water sled apparatus 600 and prevent the overturned water sled apparatus 600 from sinking into the water surface 602. The pair of lift sections 630 may equal approximately forty percent of the water sled apparatus length 600A. The running surface 640 may extend from the pair of lift sections 630 to a second end 600B of the overturned water sled apparatus 600. The second end 600B may be in contact with the water surface 602 as the overturned water sled apparatus 600 may be pulled by the towing line 610.

Figure 7:
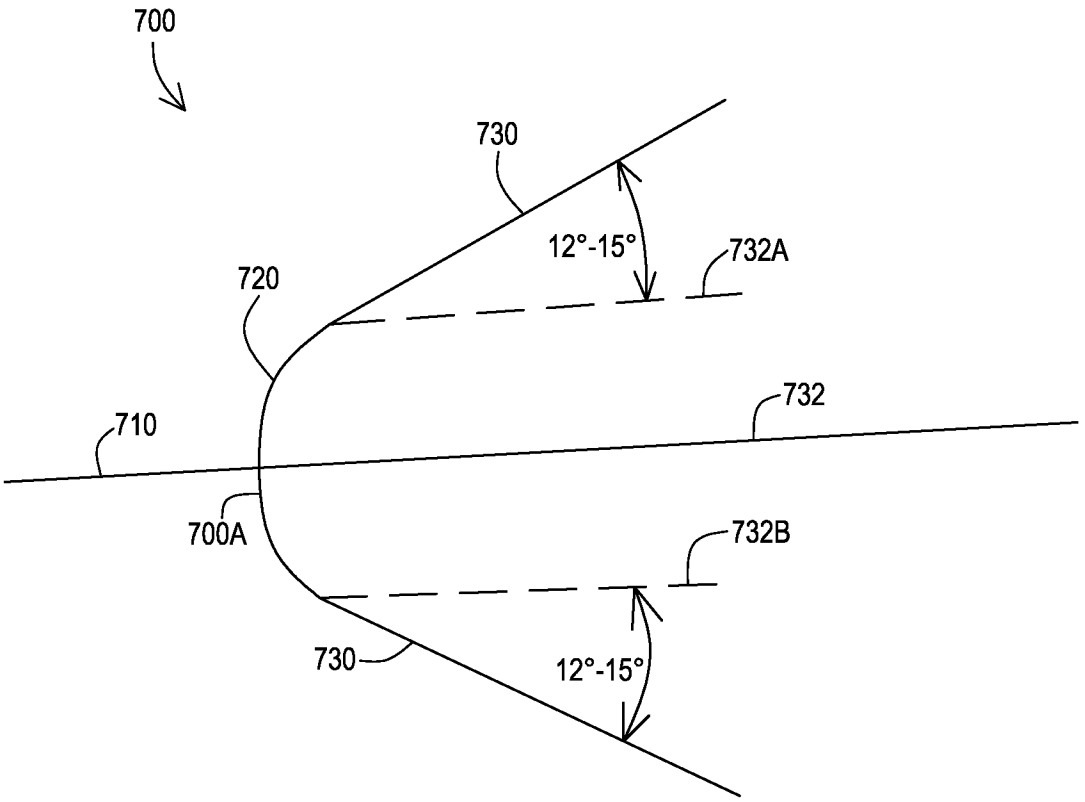
FIG. 7 illustrates a front perspective view of an overturned water sled apparatus and a towing line, in accordance with one embodiment of the present invention.

FIG. 7 illustrates a front perspective view of an overturned water sled apparatus 700 and a towing line 710, in accordance with one embodiment of the present invention.

The water sled apparatus 700 may include a tow line 710, a nose radius 720 and a pair of lift sections 730. The towing line 710 may be coupled to a first end 700A of the water sled apparatus 700. The nose radius 720 may be disposed on the first end 700A of the water sled apparatus 700. The pair of lift sections 730 may decline and rise from the nose radius 720 in the range of approximately twelve to fifteen degrees to a midline 732, a first extended midline 732A and a second extended midline 732B or other suitable range. The pair of lift sections 730 may provide lift to the water sled apparatus 700 and prevent the water sled apparatus 700 from sinking into the water surface (FIG. 6, 602).

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A water sled apparatus, comprising:

a hull;

a pair of knee indentations to accommodate a rider's knees while the rider is riding the water sled apparatus;

a pair of handles disposed on each side of the water sled apparatus;

a bumper pad disposed in front of the knee indentations to provide padding and protection to the rider while riding;

a towing line to pull the water sled apparatus, the towing line is coupled to a first end of the water sled apparatus to pull the water sled apparatus along a water surface, an overturned water sled apparatus is designed to provide lift to the overturned water sled apparatus thereby preventing the overturned water sled apparatus from diving below the water surface, the towing line is above the water surface while pulling the overturned water sled apparatus along the water surface;

a nose radius disposed on the first end of the water sled apparatus where the towing line is coupled to the first end of the water sled apparatus;

a pair of lift sections declining from the nose radius, the nose radius transitions to the pair of lift sections to provide lift to the overturned water sled apparatus and prevents the overturned water sled apparatus from sinking into the water surface, the pair of lift sections declines from the nose radius in the range of twelve to fifteen degrees; and a running surface extending from the pair of lift sections, the running surface is in contact with the water surface as the water sled apparatus is pulled by the towing line.

2. The water sled apparatus according to claim 1, wherein the hull is made of solid molded plastic or solid compression formed polymer.

3. The water sled apparatus according to claim 1, wherein the knee indentures accommodate any sized rider.

4. The water sled apparatus according to claim 3, wherein the knee indentations and the bumper pad are made of foam rubber.

5. The water sled apparatus according to claim 1, wherein the handles are made of plastic or metal.

6. The water sled apparatus according to claim 1, wherein the handles have a nonslip rubber gripping surface.

7. The water sled apparatus according to claim 1, wherein the water sled apparatus does not sink or drop while being towed.

8. The water sled apparatus according to claim 1, wherein the pair of lift sections equals forty percent of the water sled apparatus length.

9. A towed water sled apparatus, comprising:

a hull;

a pair of knee indentations to accommodate any sized rider's knees while the rider is riding the water sled apparatus;

a pair of handles with a non-slip gripping rubber surface, the pair of handles disposed on each side of the water sled apparatus;

a bumper pad disposed in front of the knee indentations to provide padding and protection to the rider while riding;

a towing line to pull the water sled apparatus, the towing line is coupled to a first end of the water sled apparatus to pull the water sled apparatus along a water surface, an overturned water sled apparatus is designed to provide lift to the overturned water sled apparatus thereby preventing the overturned water sled apparatus from diving below the water surface and the towing line is above the water surface while pulling the overturned water sled apparatus along the water surface;

a nose radius disposed on the first end of the water sled apparatus where the towing line is coupled to the first end of the water sled apparatus;

a pair of lift sections declining from the nose radius, the pair of lift sections equals forty percent of the water sled apparatus length, the nose radius transitions to the pair of lift sections to provide lift to the overturned water sled apparatus and prevents the overturned water sled apparatus from sinking into the water surface, the pair of lift sections declines from the nose radius in the range of twelve to fifteen degrees;

a running surface extending from the pair of lift sections, the running surface is in contact with the water surface as the water sled apparatus is pulled by the towing line.

10. The water sled apparatus according to claim 9, wherein the hull is made of solid molded plastic or solid compression formed polymer.

11. The water sled apparatus according to claim 9, wherein the knee indentations and the bumper pad are made of foam rubber.

12. The water sled apparatus according to claim 9, wherein the handles are made of plastic or metal.

13. A towed water sled apparatus, comprising:

a hull made of solid molded plastic or solid compression formed polymer;

a pair of knee indentations to accommodate any sized rider's knees while the rider is riding the water sled apparatus;

a pair of plastic or metal handles with a non-slip gripping rubber surface, the pair of handles disposed on each side of said the water sled apparatus;

a bumper pad disposed in front of the knee indentations to provide padding and protection to the rider while riding;

a towing line to pull the water sled apparatus, the towing line is coupled to a first end of the water sled apparatus to pull the water sled apparatus along a water surface, an overturned water sled apparatus is designed to provide lift to the overturned water sled apparatus thereby preventing the overturned water sled apparatus from diving below the water surface and the towing line is above the water surface while pulling the overturned water sled apparatus along the water surface;

a nose radius disposed on the first end of the water sled apparatus where the towing line is coupled to the first end of the water sled apparatus;

a pair of lift sections declining from the nose radius, the pair of lift sections equals forty percent of the water sled apparatus length, the nose radius transitions to the pair of lift sections to provide lift to the overturned water sled apparatus and prevents the overturned water sled apparatus from sinking into the water surface, the pair of lift sections declines from the nose radius in the range of twelve to fifteen degrees; and a running surface extending from the pair of lift sections, the running surface is in contact with the water surface as the water sled apparatus is pulled by the towing line.

14. The water sled apparatus according to claim 13, wherein the knee indentations and the bumper pad are made of foam rubber.

* * * * *